United States Patent [19]

Takehara et al.

[11] Patent Number: 4,629,675

[45] Date of Patent: Dec. 16, 1986

[54] PROCESS FOR THERMAL DEVELOPMENT AND TRANSFER

[75] Inventors: Nobumitsu Takehara; Kazuhiko Yanagihara; Masahiro Ohnishi; Isamu Hatanaka; Shigeo Harada, all of Kanagawa, Japan

[73] Assignee: Fuji Photo Film Co., Ltd., Kanagawa, Japan

[21] Appl. No.: 596,193

[22] Filed: Apr. 2, 1984

[30] Foreign Application Priority Data

Mar. 31, 1983 [JP] Japan ..... 58-55906

[51] Int. Cl.[4] ..... G03C 5/54; G03D 9/00; G03D 5/00

[52] U.S. Cl. ..... 430/203; 430/207; 430/403; 354/303; 354/305

[58] Field of Search ..... 430/203, 207, 403; 354/303, 305

[56] References Cited

U.S. PATENT DOCUMENTS 2,563,343 8/1951 Land ..... 354/303
2,719,789 10/1955 Land ..... 430/207
3,143,056 8/1964 Limberger ..... 354/305
4,338,016 7/1982 Peck et al. ..... 354/305
4,500,626 2/1985 Naito et al. ..... 430/203

FOREIGN PATENT DOCUMENTS 0076492 4/1983 European Pat. Off. ..... 430/203

*Primary Examiner*—Richard L. Shilling
*Attorney, Agent, or Firm*—Sughrue, Mion, Zinn, Macpeak and Seas

[57] ABSTRACT

A photosensitive material containing a hydrophilic pigment is exposed to light to form a pigment pattern defining a particular image. The photosensitive material is brought into intimate contact with an image receiving material having a pigment fixing layer. The mutually contacting materials are heated so that the pigment may be transferred from the photosensitive material to the pigment fixing layer. A pigment diffusion assistant, is supplied to an area between the mutually contacting materials before they are heated for pigment transfer. The diffusion assistant spreads along a line along which the two materials are in contact with each other and promotes the transfer of the pigment.

4 Claims, 7 Drawing Figures

PROCESS FOR THERMAL DEVELOPMENT AND TRANSFER

BACKGROUND OF THE INVENTION

The present invention relates to a process for thermal development and transfer. More particularly, it is concerned with an improvement in a process for forming color pictures employing a photosensitive material containing a pigment donating substance which releases a mobile hydrophilic pigment upon thermal development, and an image receiving material having a pigment fixing layer.

There is known a photosensitive material composed of a support on which is deposited at least a photosensitive silver halide, an organic silver salt as an oxidizing agent, a binder and a pigment donating substance having a reducing effect on the silver halide and/or the organic silver salt and reacting with the silver halide and/or the organic silver salt under heat to release a hydrophilic pigment. Such a photosensitive material is disclosed in Japanese Patent Application No. 157798/1981. This material has the advantage that the thermal development of an image after exposure is sufficient to form simultaneously a silver-based image in an exposed area and a mobile hydrophilic pigment in an area corresponding to the silver-based image. More specifically, if an image formed by exposure is subjected to thermal development, an oxidation-reduction reaction takes place between the organic silver salt and the reducing pigment donating substance to form a silver-based image in the exposed area, while the exposed photosensitive silver halide acts as a catalyst for the reaction. The pigment donating substance is oxidized by the organic silver salt to form an oxide. This oxide is decomposed in the presence of a pigment releasing assistant and releases a mobile hydrophilic pigment. The silver image and the mobile hydrophilic pigment are thus obtained in the exposed area, and a color picture is obtained when the pigment is transferred onto an image receiving material. If an autopositive emulsion is employed for the photosensitive layer, the silver image and the mobile hydrophilic pigment are formed in the unexposed area.

Another photosensitive material is disclosed in Japanese Patent Application No. 26008/1983 filed by the assigneee of this invention on Feb. 18, 1983 and entitled "Image Forming Process". In that material, on a support is deposited at least a photosensitive silver halide, a binder and a photosensitive layer containing an immobile pigment donating substance which is reducing and releases a mobile hydrophilic pigment under heat but ceases to release the pigment upon reaction with the silver halide. This material enables, only if subjected to thermal development after exposure, the simultaneous formation of a silver-based image in the exposed area and a mobile hydrophilic pigment in areas other than the silver-based image.

The immobile pigment donating substance ceases to release the hydrophilic pigment if it is oxidized. If the photsensitive material is heated after exposure, an oxidation-reduction reaction takes place between the organic silver salt and/or photosensitive silver halide and the pigment donating substance to form a silver-based image in the exposed area, while the exposed silver halide acts as a catalyst for the reaction. The pigment donating substance forms an oxide and ceases to release the hydrophilic pigment in the exposed area, and the mobile hydrophilic pigment is therefore obtained only in the unexposed area. If an autopositive emulsion is employed for the photosensitive layer, the silver-based image is formed in the unexposed area and the mobile hydrophilic pigment in the exposed area.

The image receiving material has an image receiving layer formed on a support for receiving the pigment released from the photosensitive material by thermal development as hereinabove described. The image receiving layer contains a pigment fixing agent, such as a pigment mordant. The pigment fixing agent is selected so as to suit the physical properties of the pigment, the other constituents of the photosensitive material and the conditions of transfer. It is possible to use, for example, a high polymer mordant as disclosed in Japanese Patent Application No. 157798/1981.

It is necessary to supply a diffusion assistant to the image receiving material before placing it on the photosensitive material for transfer purposes. If the diffusion assistant is of the type which is converted to a liquid when heated, such as urea, water of crystallization or an agent in a microcapsule, it is incorporated into the image receiving material during its production, and need not be supplied before it is placed on the photosensitive material. If, on the other hand, the diffusion assistant is water or an aqueous solution, it must be supplied to the image receiving material when it is placed on the photosensitive material.

SUMMARY OF THE INVENTION

It is an object of the invention to provide a process which enables improved thermal development and transfer in the event water or an aqueous solution is used as the diffusion assistant.

This object is attained by a process including the steps of exposing to an image-forming pattern of light a photosensitive material releasing a hydrophilic pigment which is transferable from an exposed or unexposed area under heat, heating the photosensitive material to develop an image from the pigment, and bringing the photosensitive material into contact with an image receiving material having a pigment fixing layer, wherein an aqueous diffusion assistant, which is water or an aqueous solution is supplied to a zone between the photosensitive material and the image receiving material so that it may spread along a line along which the photosensitive material and the image receiving material are in contact with each other, to thus effect the migration of the pigment into the pigment fixing layer on the image receiving material.

DESCRIPTION OF THE PREFERRED EMBODIMENTS

Figure 1:
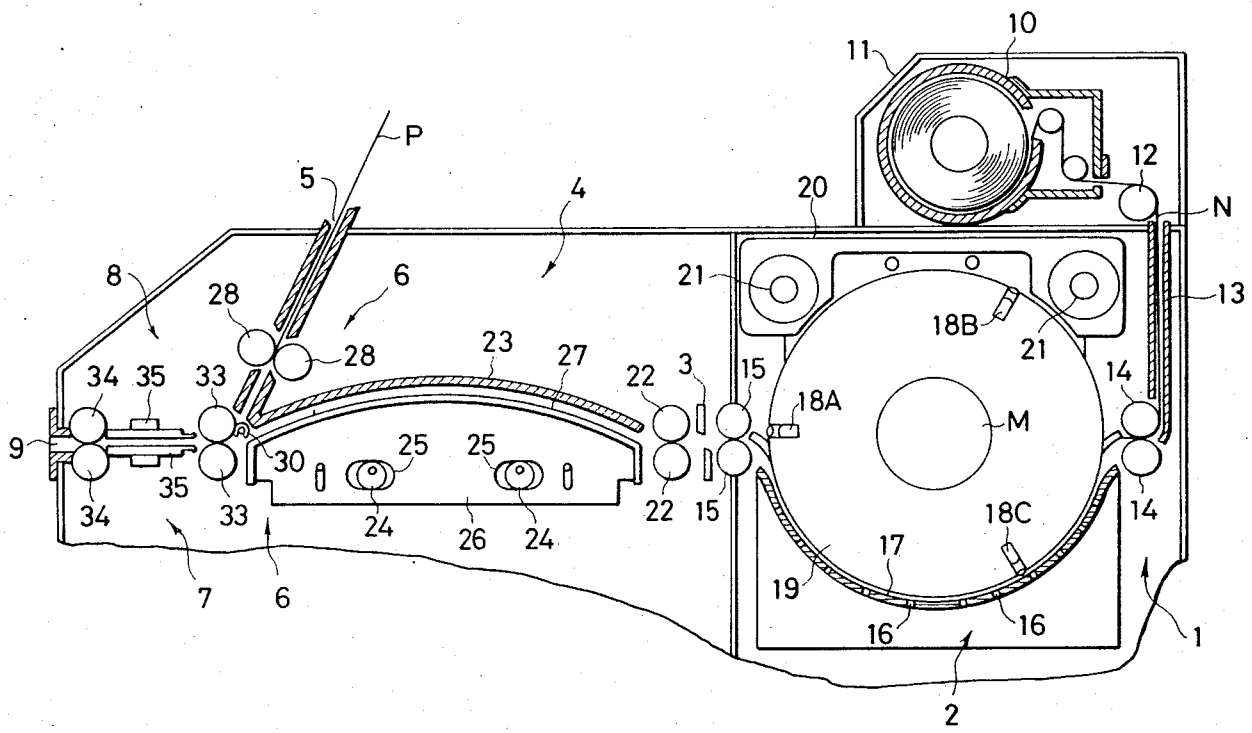
FIG. 1 is a side elevational view, partly in section, of an apparatus which may be used to carry out the process of the invention.

The process of the invention may be carried out by an apparatus which is shown by way of example in FIG. 1. The apparatus includes a photosensitive material supply zone 1, an exposure zone 2, a cutter 3, a thermal development zone 4, an inlet 5 for an image receiving material, a diffusion assistant supply zone 6, a contacting zone 7, a thermal transfer zone 8 and an outlet 9. The photosensitive material supply zone 1 includes a housing 11 in which a magazine 10 containing a roll of a photosensitive material N is shielded against light, a guide roller 12, a guide member 13, and feed rollers 14 and 15 which feed the photosensitive material N to the exposure zone 2 and hold it therein.

The exposure zone 2 contains an arcuate surface for supporting the photosensitive material N, a main scanning rotor 19 upon which are mounted three LEDs (light-emitting diodes) 18A to 18C, a motor for rotating the rotor 19, a movable body 20, and a pair of rotary shafts 21 from which the movable body 20 is suspended and in which are formed screw threads via which the movable body 20 is moved for auxiliary scanning purposes. The supporting surface 17 has a plurality of suction holes 16 formed therein used to bring the rear side of the photosensitive material N into intimate contact with the supporting surface 17 when a vacuum pressure is supplied. The LEDs 18A to 18C, which are equally spaced by angles of 120° around the outer circumference of the rotor 19, produce outputs at different wavelengths. The intensity and duration of their outputs are controlled in accordance with image signals B (blue), G (green) and R (red).

In the thermal development zone 4 are provided a pair of feed rollers 22, an arcuately curved guide plate 23 and an arcuately curved heating plate 27 mounted on a support 26 movable to and away from the guide plate 23. The support 26 is provided with a pair of elongated holes 25, and a cam 24 is positioned in each of the holes 25. The rotation of the cams 24 causes the heating plate 27 to move toward and away from the guide plate 23.

Figure 2:
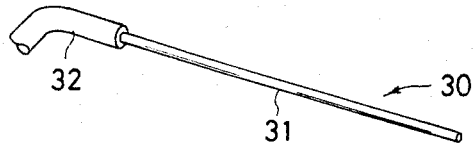
FIG. 2 is an enlarged perspective view of a pipe for supplying an aqueous diffusion assistant.

The diffusion assistant supply zone 6 has a pair of feed rollers 28 by which a sheet of an image receiving material P introduced manually through the inlet 5 is fed to the contacting zone 7, and a supply pipe 30 provided adjacent to one end of the guide plate 23 for supplying water or an aqueous solution as a diffusion assistant to the image receiving material P. The pipe 30 has an outlet 31 located approximately in the middle of the width of the photosensitive material N and the image receiving material P, as can be seen in FIG. 2. The pipe 30 is connected by a hose 32 to a diffusion assistant supply device which is adapted to supply a diffusion assistant in a controlled quantity to the pipe 30, as will hereinafter be described in further detail.

In the contacting zone 7 are provided a pair of contacting rollers 33 by which the photosensitive material N subjected to thermal development and the image receiving material P to which the diffusion assistant has been applied are brought into intimate contact with each other and fed to the thermal transfer zone 8. The thermal transfer zone 8 includes a pair of heaters 35 between which the materials N and P held in intimate contact with each other are heated, and a pair of feed rollers 34 which rotate at the same spped as the contacting rollers 33 and which deliver the materials N and P through the outlet 9 of the apparatus.

Figure 3:
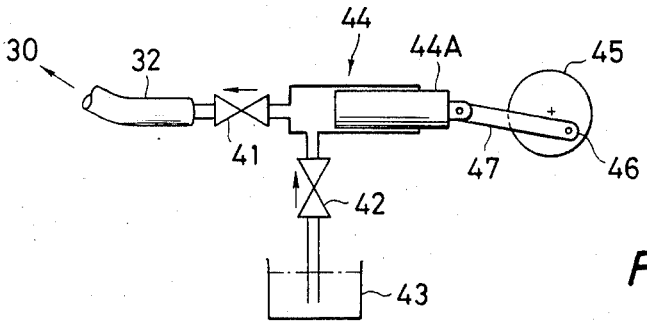
FIG. 3 is a schematic view showing a device for supplying the aqueous diffusion assistant to the pipe shown in FIG. 2.

Referring to FIG. 3, the diffusion assistant supply device is shown by way of example. The device includes a cylinder 44 connected to a diffusion assistant reservoir 43 through a check valve 42 which permits flow only in the direction from the reservoir 43 to the cylinder 44, as shown by an arrow. A piston 44A disposed in the cylinder 44 has an outer end connected to one end of an arm 47, the other end of which is connected by a pin 46 to a disk 45 which is in turn connected to the output shaft of a motor (not shown). A check valve 41 is provided between the hose 32 and the cylinder 44 which permits flow only in the direction from the cylinder 44 to the hose 32, as shown by an arrow. The pin 46 is connected to the disk 45 to thereby vary the quantity of the diffusion assistant which is supplied by the device during each rotation of the motor.

A description will now be given of the operation of the apparatus hereinabove described in conjunction with the process of this invention. The photosensitive material N is withdrawn from the magazine 10 and engaged with the feed rollers 14 at a position past the guide roller 12 and the guide member 13. The feed rollers 14 and 15 are rotated to feed the material N along the supporting surface 17 until its leading edge is located between the feed rollers 15. Air is drawn through the suction holes 16 to bring the material N into intimate contact with the supporting surface 17. The rotor 19 and the shafts 21 are rotated to effect the scanning of the LEDs 18A to 18C for exposure purposes, while the image signals B, G and R are being transmitted thereto. Then, the feed rollers 14, 15 and 22 and the contacting rollers 33 are rotated to move the material N forward between the cutting edges of the cutter 3, the feed rollers 22 and between the guide plate 23 and the heating plate 27 until its leading edge is located between the contacting rollers 33. The cutter 3 is driven to cut the material N between the feed rollers 15 and the feed rollers 22. The cams 24 are rotated to raise the heating plate 27 toward the guide plate 23. The heating plate 27, brought into intimate contact with the rear surface of the material N by the tension maintained on the material N, heats the material N for development purposes. After a predetermined period of developing time has passed, the cams 24 are rotated to lower the heating plate 27 away from the guide plate 23.

The feed rollers 28 start rotating upon completion of the developing operation to feed the image receiving material P to the contacting zone 7. Upon arrival of the leading edge of the image receiving material P at the contacting rollers 33, the feed rollers 22, contacting rollers 33 and feed rollers 34 are rotated, and the diffusion assistant supply device is placed in operation for a predetermined period of time to supply a predetermined quantity of the diffusion assistant to the contacting zone 7 between the photosensitive material N and the image receiving material P through the outlet 31 of the supply pipe 30. The diffusion assistant spreads immediately by a capillary action to form a bead along the line along which the materials N and P contact one another. The bead extends substantially uniformly along the width of the materials N and P.

Then, the mutually contacting materals N and P are heated between the heaters 35 for transfer purposes, and discharged through the outlet 9. The image receiving material P is manually separated from the photosensitive material N. A hard copy is thus obtained on the image receiving material P.

Figure 4A:
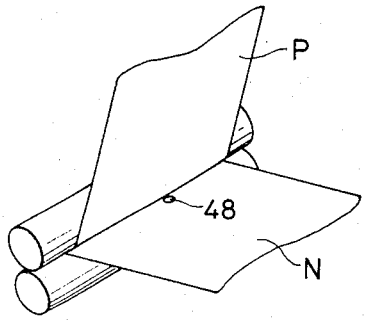
FIGS. 4A and 4B illustrate the mode in which the aqueous diffusion assistant forms a bead.
Figure 4B:
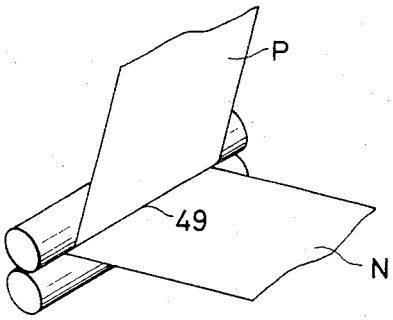

FIGS. 4A and 4B illustrate the mode in which the bead is formed between the materials N and P. The diffusion assistant is supplied in the form of a drop 48 approximately in the middle of the width of the materials N and P. A period of time not exceeding 0.5 second is sufficient for the drop 48 to form the bead 49 along the entire material width of typically 120 mm.

Figure 5:
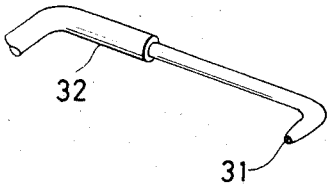
FIGS. 5 and 6 are perspective views of modified pipes for supplying the aqueous diffusion assistant.
Figure 6:
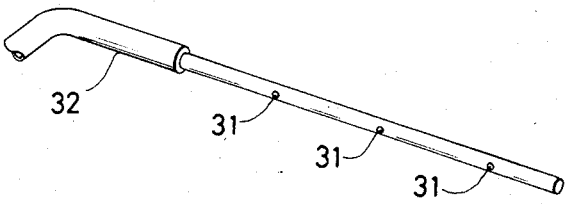

A modified pipe for supplying the diffusion assistant is shown in FIG. 5. The modified pipe has an outlet 31 at its free end. This pipe has the advantage that the point at which the diffusion assistant is supplied can be controlled more accurately. Another modified pipe shown in FIG. 6 has a plurality of outlets 31. The provision of a plurality of outlets 31 is effective for a more uniform supply of the diffusion assistant.

Although a temperature in the range of about 80° C. to about 250° C. can be satisfactorily employed for development purposes, it is particularly effective to use a temperature of about 110° C. to about 160° C. The transfer temperature may be in the range between the temperature employed for the development purpose and the ambient temperature prevailing around the apparatus. It is, however, particularly preferable to employ a temperature which is at least about 10° C. lower than the developing temperature. It therefore follows that a developing temperature of 120° C. and a transfer temperature of 20° C. to 110° C. can, for example, be employed satisfactorily.

The heating of the photosensitive material for development purposes can be effected in various ways, for example, by passing it between a pair of hot plates, bringing it into contact with a hot plate or a rotating hot drum or roller, passing it through hot air, or employing a roller, belt or other guide member to dispose the material along a source of heat supply. It is also possible to form an electrically conductive layer on the photosensitive material of, for example, graphite, carbon black or a metal with an electric current being supplied thereto. Any of these methods is also applicable to heating for transfer purposes.

The exposure of the photosensitive material to form a latent image therein may be effected by employing radiant energy, including visible light. It is usually possible to use any ordinary source of light employed for color printing, for example, a tungsten lamp, a mercury lamp, a halogen lamp such as an iodine lamp, a xenon lamp, a laser, a CRT, a fluorescent tube or a light-emitting diode.

The process of the invention is applicable to not only a line image as in a design drawing, but also to a gradated image as in a photograph. It is also possible to employ a camera to reproduce a picture of a person or scene. The printing of any such original may be effected by contact printing, reflection printing or enlargement printing. It is also possible to effect the contact or optical reflection printing of a picture taken by, for example, a video camera or a picture transmitted form a TV station by applying a corresponding picture signal directly to a CRT (cathode-ray tube) or FOT (fiber optics cathode-ray tube).

In the event LEDs are used for exposure purposes, it is still difficult to obtain sufficient blue light. In order to reproduce a color picture under these circumstances, it is effective to use, for example, a photosensitive material having photosensitive layers which release yellow, magenta and cyan dyes when exposed to green, red and infrared lights, respectively, which are emitted by corresponding LEDs. In other words, the photosensitive layer which is sensitive to green light contains a substance donating a yellow pigment, the layer which is sensitive to red light contains a magenta pigment donating substance, and the layer which is sensitive to infrared light contains a cyan pigment donating substance.

The printing of the original may be effected by any method other than contact or projection printing. For example, it is possible to employ a light receiving element such as a photoelectric tube or CCD to read an original image and record it in, for example, a computer so that the recorded information may be processed as required on a case-by-case basis. The information may be reproduced on a CRT which acts a source of light having an image-defining pattern. Alternatively, it is possible to use the processed information for scanning exposure by three different types of LEDs.

According to the invention, the diffusion assistant may be water or an aqueous solution. The water is not limited to pure water, but also includes common tap and industrial water. The aqueous solution may contain a photographically useful substance such as a base or surface active agent. An appropriate quantity of the diffusion assistant supplied to the mutually contacting photosensitive and image receiving materials may, for example, be at least 10% of the dry weight of the whole coated films on the materials, but not in excess of the weight of the films in their maximum swollen state minus their dry weight.

If the image receiving material P has a trailing edge to which a liquid absorbing member is connected, it is possible to protect the contacting rollers 33 and the feed rollers 34 against contamination by the diffusion assistant.

We claim:

1. In a process for thermal development and transfer comprising steps of exposing to light a photosensitive material containing silver halide layers and a hydrophilic dye to form a pigment pattern defining a particular image, said pigment being transferable when heated; bringing said material into intimate contact with an image receiving material having a pigment fixing layer; and heating said photosensitive and image receiving materials to transfer said pigment of said pigment fixing layer, the improvement which comprises;

supplying an aqueous pigment diffusion assistant to an area between said photsensitive and image receiving materials in such a manner that it can spread along a line along which said materials contact one another, and can assist the transfer of said pigment; and wherein said aqueous diffusion assistant is supplied through a pipe disposed between said materials and extending transversely thereof, said pipe having a single outlet opening located at a point approximately in the middle of its length such that said aqueous diffusion assistant is supplied from said opening one drop at a time to a point approximately in the middle of the width of said materials, each said drop spreading to form a bead between said materials.

2. The process as set forth in claim 1, wherein said aqueous diffusion assistant is water.

3. The process as set forth in claim 1, wherein said aqueous diffusion assistant is a solution of a photgraphically useful substance selected from the group consisting of bases and surface active agents.

4. In a process for thermal development and transfer comprising steps of exposing to light a photosensitive material containing silver halide layers and a hydrophilic dye to form a pigment pattern defining a particular image, said pigment being transferable when heated; bringing said material into intimate contact with an image receiving material having a pigment fixing layer; and heating said photsensitive and image receiving materials to transfer said pigment of said pigment fixing layer, the improvement which comprises;

supplying an aqueous pigment diffusion assistant to an area between said photsensitive and image receiving materials in such a manner that it can spread along a line along which said materials contact one another and can assist the transfer of said pigment; and wherein said aqueous diffusion assistant is supplied through a pipe disposed between said materials and extending transversely thereof, said pipe having a single outlet opening located at a free end thereof, remote from an end connected to a source of said aqueous diffusion assistant, such that said aqueous diffusion assistant is supplied from said opening one drop at a time to a pont approximately in the middle of the width of said materials, each said drop spreading to form a bead between said materials.

* * * * *